US008561434B2

(12) United States Patent
Busi

(10) Patent No.: US 8,561,434 B2
(45) Date of Patent: Oct. 22, 2013

(54) CIRCULAR KNITTING MACHINE, A METHOD FOR KNITTING AN ARTICLE WITH A CIRCULAR KNITTING MACHINE AND AN ITEM OF CLOTHING

(75) Inventor: Mauro Busi, Botticino Sera (IT)

(73) Assignee: Steps Holding B.V., Oost West en Middelbeers (NL)

( * ) Notice: Subject to any disclaimer, the term of this patent is extended or adjusted under 35 U.S.C. 154(b) by 0 days.

(21) Appl. No.: 13/695,787

(22) PCT Filed: May 4, 2010

(86) PCT No.: PCT/IB2010/051955
§ 371 (c)(1),
(2), (4) Date: Nov. 1, 2012

(87) PCT Pub. No.: WO2011/138640
PCT Pub. Date: Nov. 10, 2011

(65) Prior Publication Data

US 2013/0055767 A1 Mar. 7, 2013

(51) Int. Cl.
*D04B 9/00* (2006.01)

(52) U.S. Cl.
USPC ..... 66/40; 66/216

(58) Field of Classification Search
USPC ..... 66/38, 40, 216, 217, 57, 8
See application file for complete search history.

(56) References Cited

U.S. PATENT DOCUMENTS

| | | | | |
|---|---|---|---|---|
| 5,425,252 | A * | 6/1995 | Lonati | 66/219 |
| 7,207,196 | B2 * | 4/2007 | Lonati et al. | 66/222 |
| 7,392,669 | B2 * | 7/2008 | Lonati et al. | 66/57 |
| 2006/0117804 | A1 | 6/2006 | Lonati | |

FOREIGN PATENT DOCUMENTS

WO 2008/072048 6/2008

OTHER PUBLICATIONS

ISR for PCT/IB2010/051955 mailed on Dec. 6, 2010.
WO for PCT/IB2010/051955 mailed on Dec. 6, 2010.

* cited by examiner

*Primary Examiner* — Danny Worrell
(74) *Attorney, Agent, or Firm* — Ladas & Parry, LLP

(57) ABSTRACT

A circular knitting machine and a method for knitting an article with such a circular knitting machine, wherein the article is at least partially knitting by a reciprocating rotational movement of a needle cylinder in a forward direction and a backward direction. Needle elements are either being moved in axial direction of the needle cylinder by a stationary cam means according to a predetermined path of a stationary cam means or being moved in axial direction of the needle cylinder by a movable cam according to an amended path or being disengaged from the cam means and movable cam. The movement of each needle element near each movable cam can be individually controlled.

14 Claims, 14 Drawing Sheets

CIRCULAR KNITTING MACHINE, A METHOD FOR KNITTING AN ARTICLE WITH A CIRCULAR KNITTING MACHINE AND AN ITEM OF CLOTHING

CROSS-REFERENCE TO RELATED APPLICATIONS

This application is the U.S. National Stage of International Patent Application No. PCT/IB2010/051955 filed on May 4, 2010, the disclosure of which is hereby incorporated by reference in its entirety.

FIELD OF THE INVENTION

The invention relates to a circular knitting machine comprising at least a rotatable needle cylinder provided with a number of axially extending slots, which needle cylinder is at least reciprocatingly rotatable in a forward direction and a backward direction a number of needle elements slidably located in the slots, each needle element being provided with at least one cam follower and near an upper end thereof with a hook and a pivotably latch, stationary cam means for moving the needle element in axial direction according to a predetermined path, which circular knitting machine is further provided with actuation means for moving at least the cam follower of each needle element from an active position in which the cam follower is engageable with the cam means for moving the needle element in axial direction to an inactive position in which the cam follower is disengaged of the cam means, and vice versa.

The invention also relates to a method for knitting an article with a circular knitting machine as well as to an item of clothing.

BACKGROUND OF THE INVENTION

By such a circular knitting machine which is disclosed in WO 2007/113659 the cam means is provided with a large number of cams having a fixed position in the circular knitting machine. A selection device is being used for moving a heel of a needle from an active position in which the heel will follow a retraction cam to an inactive position in which the heel of the needle will not follow the retraction cam but will pass along the retraction cam. If the retraction cam is being followed, the needle must pass all the fixed cams like extraction cams, knockover cams, central cams and complementary cams.

This renders the known circular knitting machine rather inflexible. Furthermore, the needles will follow a number of cams wherein the axial movement of the needles due to the cams does not contribute to the knitting process.

SUMMARY OF THE INVENTION

It is an object of the invention to provide a circular knitting machine whereby for each individually needle element, the path to be followed can be controlled.

This object is achieved by the circular knitting machine according to the invention in that the knitting machine comprises at least one first and one second movable cam, each movable cam being movable between a rest position and a use position for amending the predetermined path of the cam means and vice versa, wherein when the needle cylinder is being rotated in the forward direction the first movable cam is movable into its use position, whilst when the needle cylinder is being rotated in the backward direction the second movable cam is movable into its use position, wherein near each movable cam actuation means are provided for individually moving at least the cam follower of each needle element from an active position in which the cam follower is engageable with the corresponding movable cam to an inactive position in which the cam follower is disengaged of the corresponding movable cam, and vice versa.

By having movable cams wherein for each movable cam it can be decided whether it will be moved to its use position and if it is in its use position whether an individual needle element will have to follow the path defined by the respective cam, a large amount of possibilities for knitting different kind of articles with different kind of knitting patterns is obtained. The movement in axial direction of each needle element can easily be optimized. Furthermore, if a cam is not needed during a certain period of time, it can be moved to its rest position so that the needle elements being in their active position will follow the path as defined by the cam means, whilst the needle elements being in their inactive position will maintain their axial position independent of the path as defined by the cam means. In this manner, the number of elements which need to be moved on each step of the knitting process can be minimized.

An embodiment of the circular knitting machine according to the invention is characterized in that the knitting machine comprises at least two pairs of movable cams, each pair one first and one second movable cam, wherein the pairs are spaced apart in the rotational direction.

By having two pairs of cams, it is possible to have two feeds of yarns at two different positions on the needle cylinder, due to which during one rotational movement of the needle cylinder, two rows of stitches will be obtained. The rows can be made of different kind of yarns, yarns with different kind of colours etc. During such rotational movement the needle cylinder may be moved over for example more than 500 degrees, for example 540 degrees. The knitting of the article is being done on a row of needle elements. When moving in forward direction, the first needle elements of said row will be moved along the path defined by the first movable cam of the first pair. Depending on the length of the row, the last needle elements of the row will than be located near the first movable cam of the second pair. However, it is not desirable and even unwanted that these last needle elements will already follow the path of this cam. So the cam will be put in its rest position. As soon as the last needle elements have passed the first movable cam of the second pair, the cam can be brought to its use position so that as soon as the first needle elements are near this cam, they may follow the path as defined by this cam.

Another embodiment of the circular knitting machine according to the invention is characterized in that the stationary cam means define at least a first level and a second level of the needle element in axial direction, wherein the movable cam defines at least a third level of the needle element in axial direction, wherein the second level is located between the first level and the third level.

It is well known by circular knitting machines to move the needle elements between three different positions at three different levels during the knitting process to obtain the desired stitches. By defining the first level and the second level by the stationary cam means and the third level by the movable cam, the levels which can be reached by each needle element can easily be amended. The stationary cam means preferably also defines paths between the first level and the second level, whilst the movable cam preferably also defines paths between the second level and the third level.

Yet another embodiment of the circular knitting machine according to the invention is characterized in that the circular knitting machine comprises additional movable cams located closer to the upper ends of the needle elements than the movable cams, each additional movable cam being movable between a rest position and a use position, which additional movable cam defines a path for moving the needle element from the third level to the first level.

Such an additional movable is being used for moving the needle elements from a higher level, for example the second or third level to the lower first level.

Another embodiment of the circular knitting machine according to the invention is characterized in that the movable cam defines in its use position a first path for maintaining the needle element at the second level and a second inclined path connected to the first path for moving the needle element from the second level to the third level, which movable cam cooperates with the additional movable cam in its use position, wherein a needle element being moved by the movable cam from the second level to the third level is being moved by the additional movable cam from the third level to the first level.

Such combination of movable cam and additional movable cam are being used for conventional stitching stitches, wherein the needle element is brought form the first or second level to the third level, where after the needle element is brought from the third level via the second level to the first level to discharge the stitch.

Another embodiment of the circular knitting machine according to the invention is characterized in that the movable cam is triangular shaped and defines on each side an inclined path from the second level to the third level, wherein near at least one side of the movable cam the inclined path is aligned with an inclined path on the stationary cam means, which movable cam cooperates with the additional movable cam in its use position, for moving a needle element by the additional movable cam from the second level to the first level, by the stationary cam means from the first level to the second level and by the triangular shaped movable cam from the second position to the third position and back to the second position.

Such a combination of cams can be used, for supplying a yarn to the needle element when located at the second level, which supply of yarn takes places just before the needle element reaches the additional cam means. The discharge of the formed stitch is being done by means of the triangular movable cam, whereby the needle element is brought from the second level to the third level to discharge the stitch and back to the second level to be ready for the next stitching step, if maintained in it active position.

The invention also relates to a method for knitting an article with a circular knitting machine, wherein the article is at least partially knitting by a reciprocating rotational movement of the needle cylinder in a forward direction and a backward direction, wherein the needle elements are either being moved in axial direction of the needle cylinder by a stationary cam means according to a predetermined path or being moved in axial direction of the needle cylinder by a movable cam according to an amended path or being disengaged from the cam means and movable cam, wherein the movement of each needle element near each movable cam can be individually controlled.

Due to the combination of movable cams and needle elements which can be active or inactive a large number of different knitting patterns can easily be realised with a relatively limited number of moving parts and relatively simple movements of the needle elements in axial direction.

An embodiment of the method according to the invention is characterized in that the needle elements are movable between a first level, a third level and a second level located between the first and third level, wherein a least a yarn is being fed to a needle element being near the third position.

While being near its third position a previous stitch is being discharged from the latch of the needle element, so that the hook is free to receive a new yarn.

Another embodiment of the method according to the invention is characterized in that for reducing the number of needle elements on which knitting during one forward or backward movement of the needle cylinder is being performed, needles elements are brought and maintained at the first level.

At the first level no yarn can be fed to the hook and no stitching will be performed by the needle element. Since for each needle element is can be decided to maintain it at the first level, it can easily be decided how many needle elements will be used for the knitting process and the number of active needles can easily be decreased and increased in each turn of the needle cylinder.

Another embodiment of the method according to the invention is characterized in that a least a yarn is being fed to a needle element being in the second position, where after said needle element is being moved from the second position to at least the third position by a movable cam.

In this manner the yarn will be position on top of a yarn not yet discharged from the needle element. Both yarns will be discharged from the latch as soon as the needle element is brought in the third position at the third level defined by the movable cam.

Another embodiment of the method according to the invention is characterized in that a least a first yarn is being fed to a needle element being in the third position, and at least a second yarn is being fed to an adjacent needle element being in the second position where after both needle elements are brought to the first level, where after the needle element holding the second yarn is being moved from the second position to at least the third position by a movable cam.

In this manner two stitches located in the same row and located next to each other will comprise different yarns. Since for each active needle element is can be decided whether a yarn is supplied at the second position or at the third position any desired pattern can be made during the reciprocating movement of the needle cylinder.

Another embodiment of the method according to the invention is characterized in that the first yarn is being used for making a base part of the article being made with a reciprocating movement of the needle cylinder, whilst the second yarn is being used to apply a local pattern like a text or a figure on the base part during the reciprocating movement of the needle cylinder.

A stitch comprising the second yarn does also comprises the first yarn. However, this first yarn is located under the second yarn and is hidden from view by the second yarn. The invention also relates to an item of clothing like an ankle sock obtained according to the method according to the invention by reciprocating motion in continuum stitching stitches without seams to form a single piece made up of a front end elongated in the shape of a pocket, which can be associated with the toe of the foot and comprising a first and a second front portion, a rear end, also pocket shaped, able to be associated with the heel of the foot and comprising a first and a second rear portion, and of a connecting part between the front end and rear end, comprising a sole portion, two side portions and an opening between the side portions in which to insert the foot, wherein the first and second front portions, the connecting part and the first and second rear portions are each realized by alternate motion stitching with many yarns, wherein in a single row of stitches made of a first yarn only some stitches are also made of a second yarn.

In this manner all kinds of patterns like figures, text, etc. can be inserted in each part of the ankle sock during reciprocating motion of the needle cylinder, wherein a seamless ankle sock is being obtained.

BRIEF DESCRIPTION OF THE DRAWINGS

The invention will be explained in more detail with reference to the drawings, in which.

Like parts are indicated by the same reference numbers in the figures.

DETAILED DESCRIPTION OF EMBODIMENTS

Figure 1:
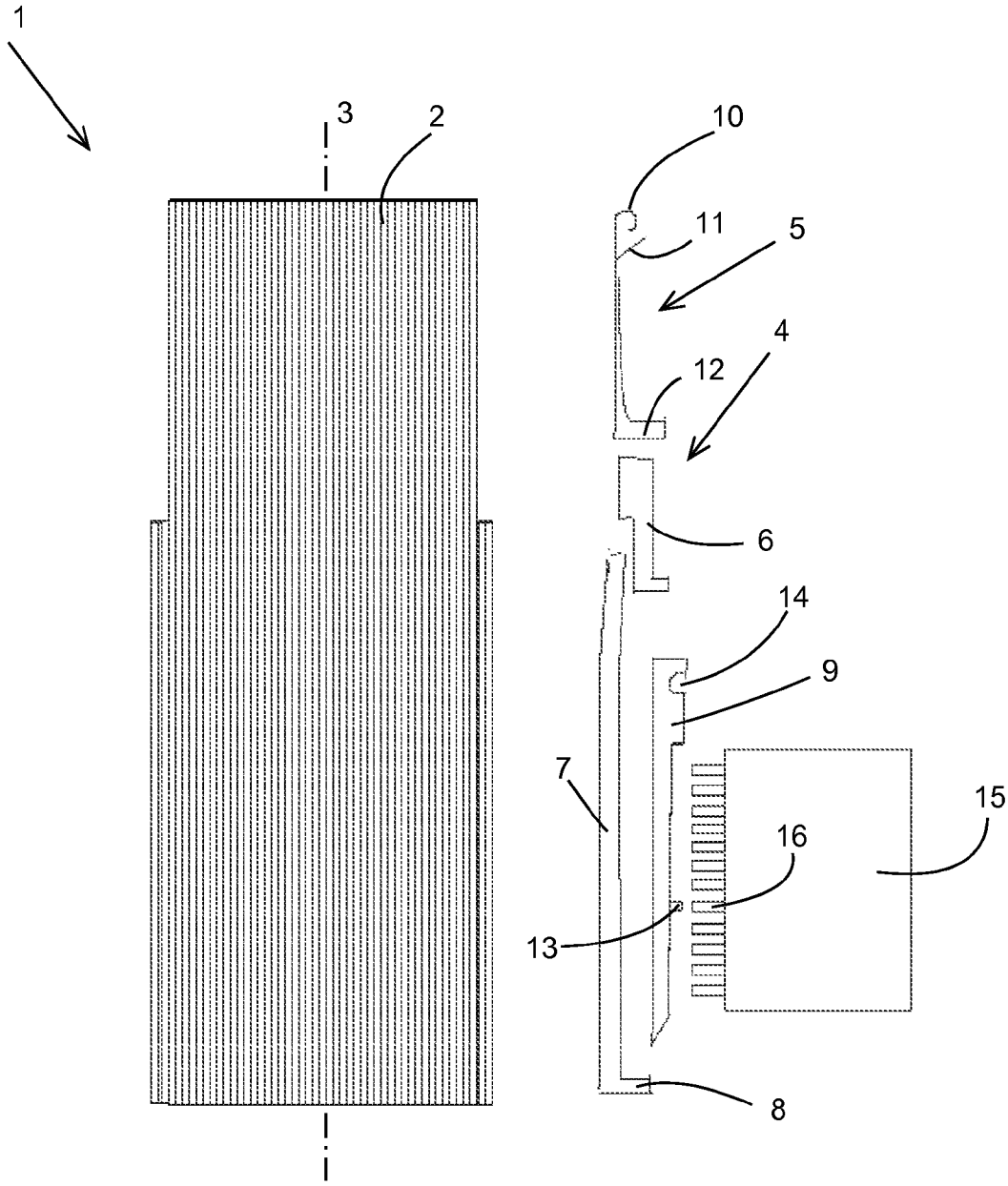
FIG. 1 is a schematic cross section of a circular knitting machine according to the invention.

FIGS. 1-11 show different views of a circular knitting machine 1 according to the invention. The circular knitting machine 1 comprises a needle cylinder 2 being rotatable in a reciprocating manner about a central axis 3. The needle cylinder 2 comprises a large number of slots extending in axial direction. In each slot a needle element 4 is slidably located, wherein each needle element 4 is slidably in axial direction parallel to the central axis 3. Each needle element 4 comprises a needle 5, a middle jack element 6, a lower jack element 7 provided with a first cam follower 8 and a selector 9. The needle 5 comprises a hook 10, a swivelable latch 11 and a second cam follower 12. The lower jack element 7 is slightly curved outwardly near the middle jack element 6. Due to the middle jack element 6, the cam follower 8 of the lower jack element 7 will be pushed in a direction away from the central axis 3. This is the normal position of the cam follower 8.

The selector 9 is provided with a pin 13 and a recess 14 for a ring shaped spring (not shown) located around the needle cylinder 2 for pressing the selectors 9 of all the needle elements 4 towards the central axis 3. The recess 14 is located at a distance of the pin 13.

Figure 2:
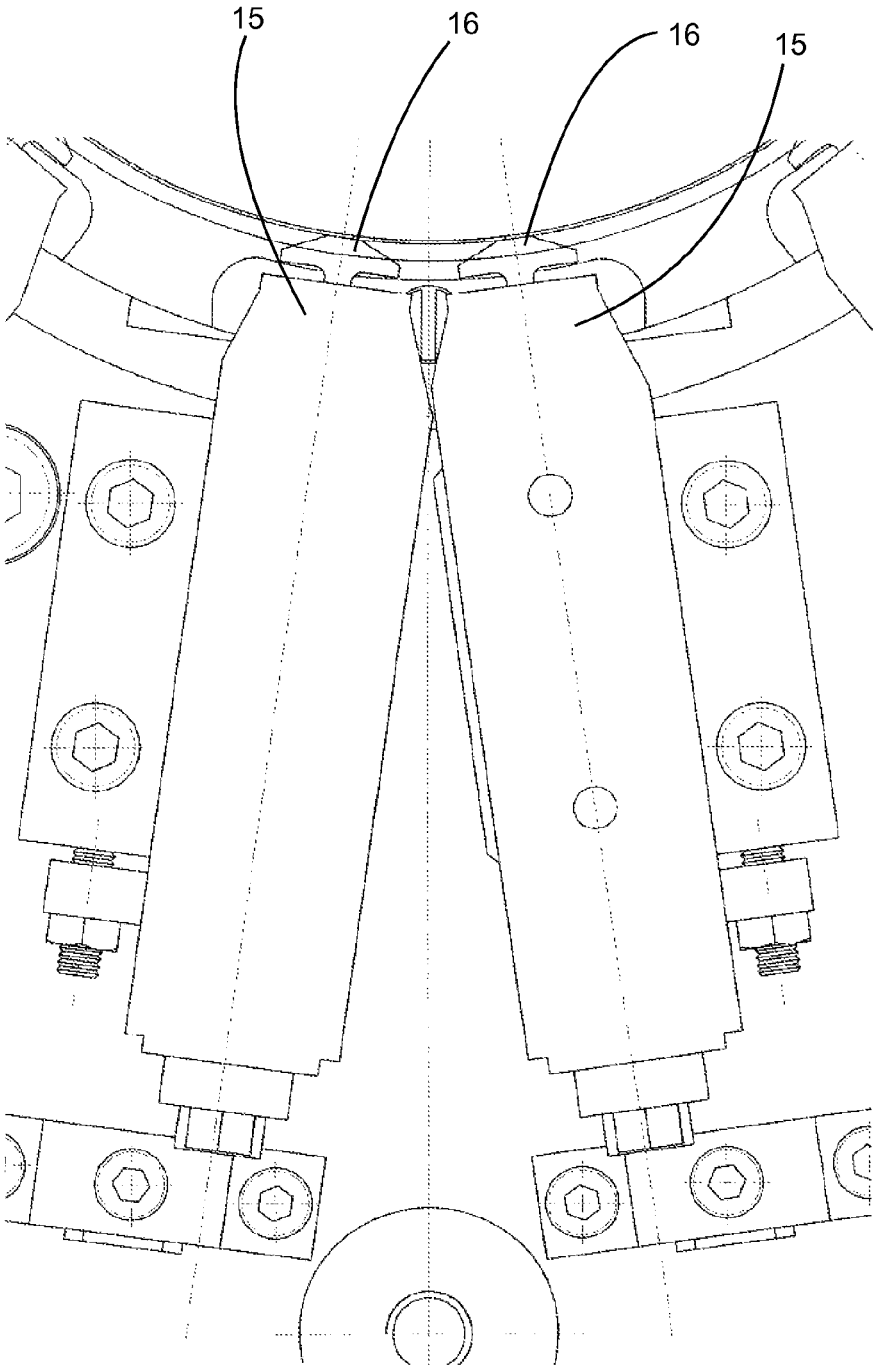
FIG. 2 is an enlarged top view of a part of the circular knitting machine according to the invention, showing actuation means for the needle elements.
Figure 3A:
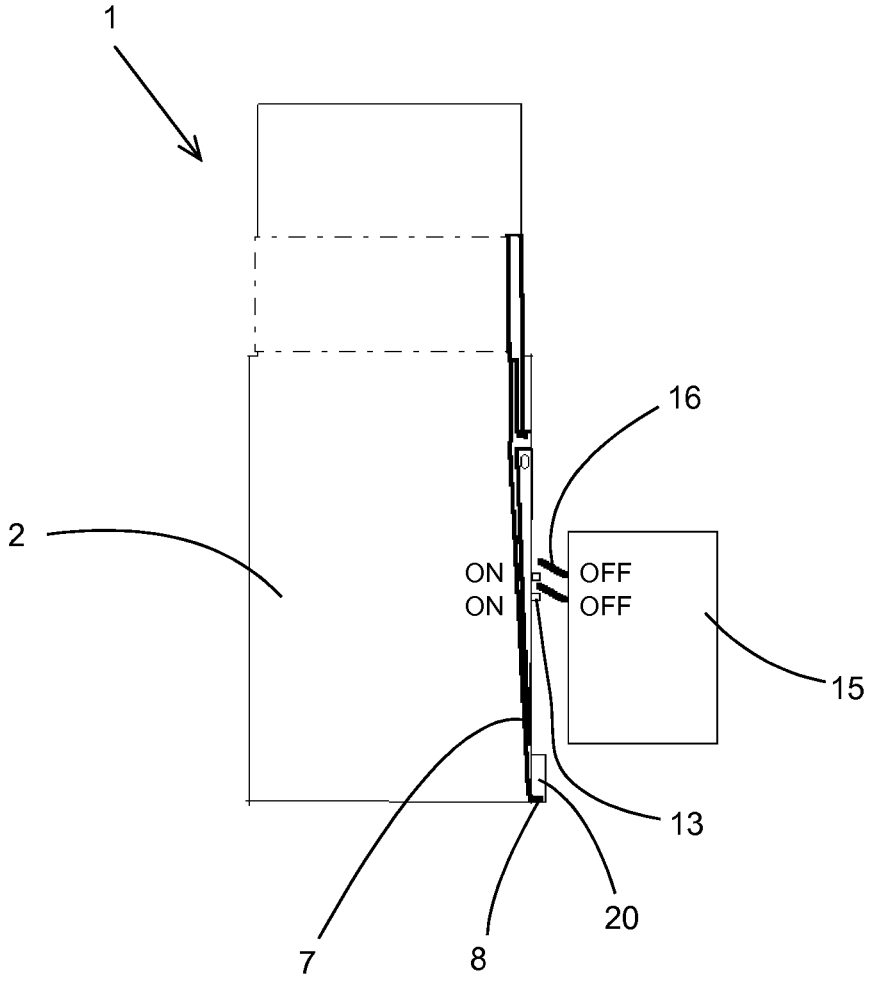
FIGS. 3A and 3B are schematic cross sections of the circular knitting machine as shown in FIG. 1, with the needle element in the active position and inactive position respectively.
Figure 3B:
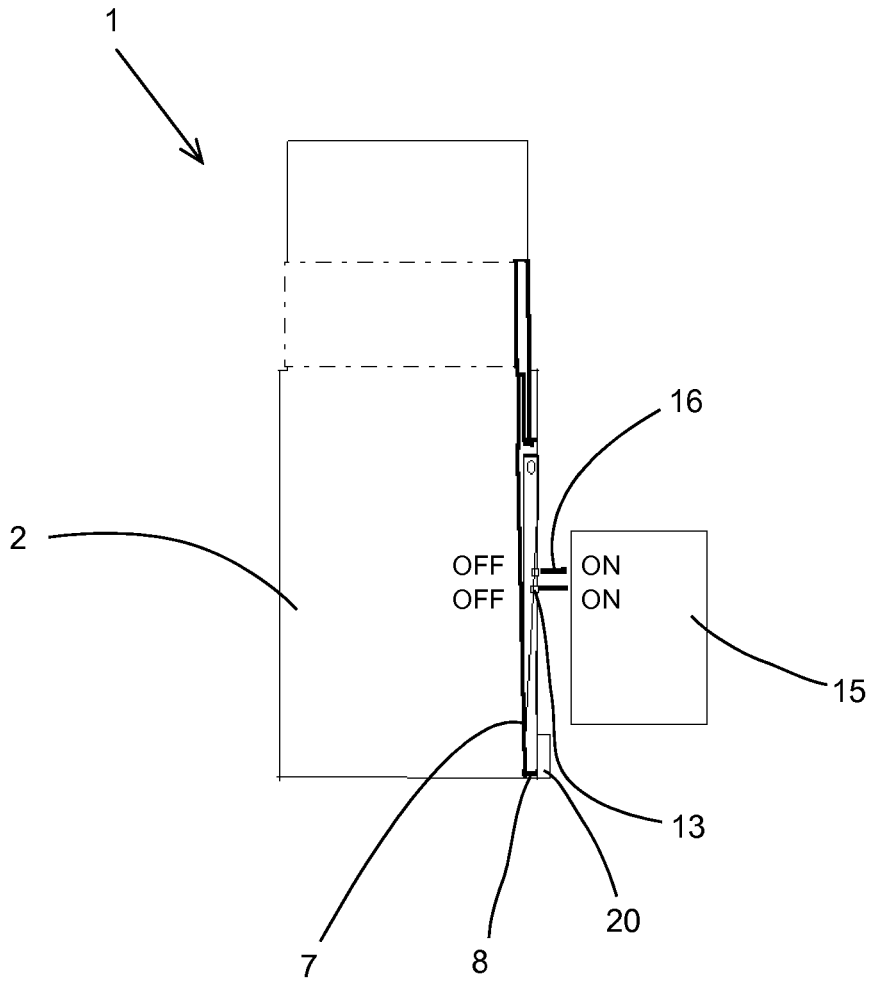

The circular knitting machine 1 is provided with eight actuation means 15, each comprising a number of triangular guiding elements 16 (see FIG. 2). The guiding elements 16 being pivotable, individually and independently of each other, in axial direction form an OFF position (see FIG. 3A) to an ON position (see FIG. 3B). In the ON position of a guiding element 16, a pin 13 of a needle element 4 passing the guiding element 16 will be moved towards the central axis 3 against spring force of the ring shaped spring and be put in an OFF position. In the OFF position of the pin 13, the needle element 4 is in its inactive position and the first cam follower 8 will not be engaged with cam means or movable cams as will be explained here below. In the OFF position of a guiding element 16, a pin 13 of a needle element 4 will simply pass the guiding element 16 and be in an ON position under spring force of the ring shaped spring, wherein the needle element 4 is in its active position and the first cam follower 8 will be engaged with the cam means or the movable cams as will be explained here below.

The movement of the guiding elements 16 is controlled by means of a computer (not shown). Due to the triangular shape of the guiding element 16 the pin 13 can be operated both during the rotation of the needle cylinder 2 in forward direction and in backward direction. The axial locations of the pin 13 of a group of for example 13 adjacent needle elements 4 are staggered with respect to each other so that each needle element 4 of the group can individually be moved from its active position to its inactive position and vice versa. The pins 13 on the next group of needles 4 is staggered in the same order.

Figure 4A:
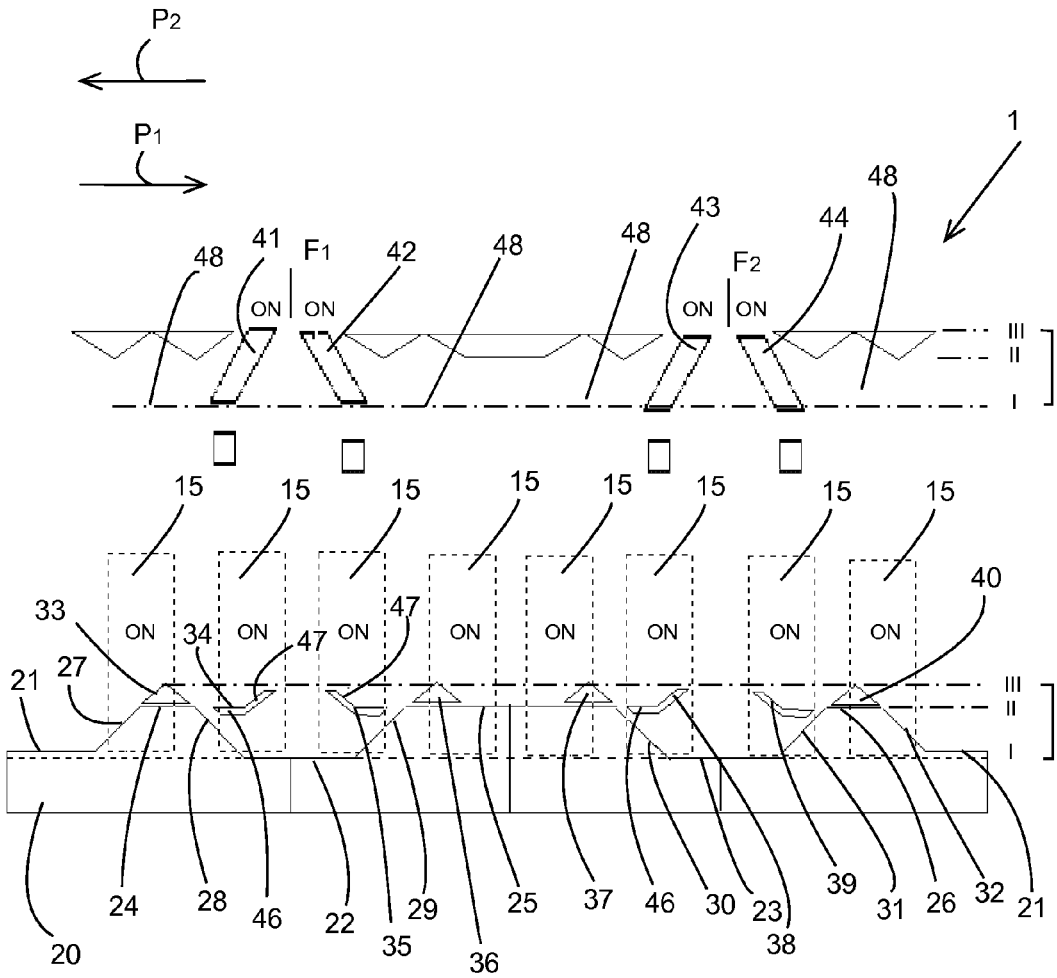
FIGS. 4A and 4B are schematic views of the circular knitting machine as shown in FIG. 1, showing the whole circumference of the cam means with movable cams in the use position and rest position respectively.
Figure 4B:
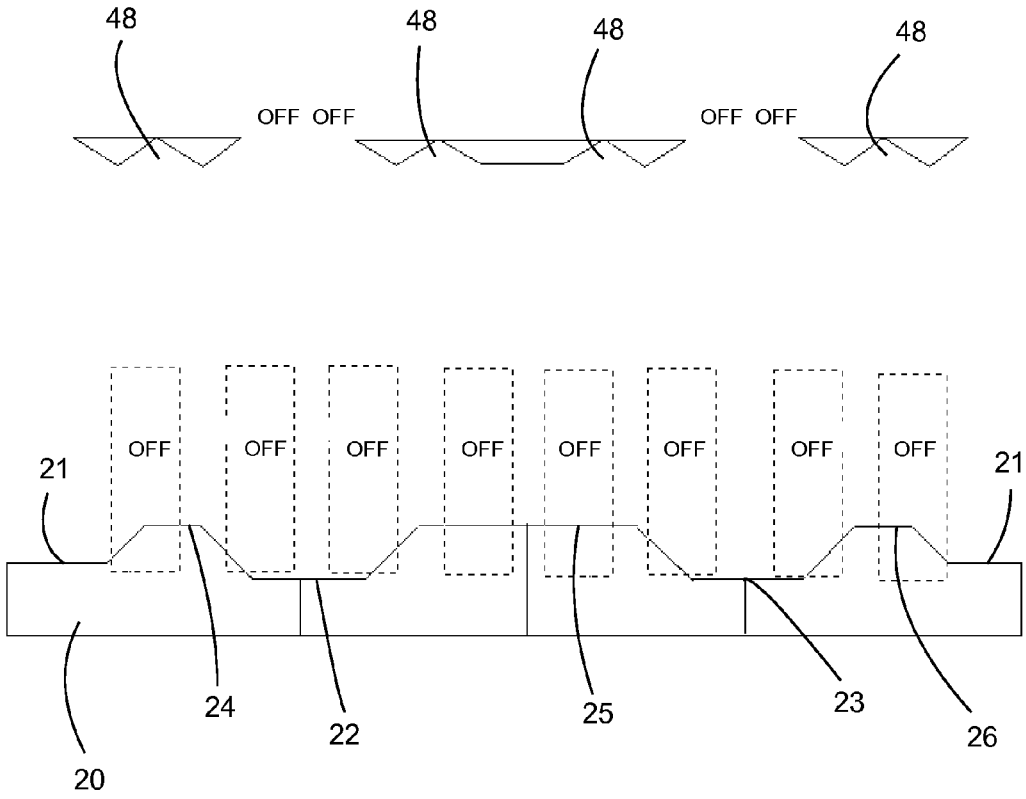

As can be seen in FIG. 4A, the circular knitting machine 1 according to the invention comprises a stationary cam means 20. The cam means 20 is ring shaped and located around the needle cylinder 2. The ends of the cam means 20 as shown in the FIG. 4A are connected to each other to form the ring shape.

The cam means 20 comprises three horizontal parts 21, 22, 23, the parts 22, 23 being at a first level I, three horizontal parts 24, 25, 26 at a second level II and six inclined parts 27, 28, 29, 30, 31, 32 between the first level I parts and the second level II parts. The horizontal part 21 being at a level slightly higher than level I but lower than level II to be able to maintain a cam follower 8 of a needle element 4 inactive at level I, if desired, as will be explained here below.

The circular knitting machine 1 according to the invention comprises eight movable cams 33, 34, 35, 36, 37, 38, 39, 40 located near the stationary cam means 20 and four additional movable cams 41, 42, 43, 44 located near additional stationary cam means 45. The movable cams 33, 34, 35, 36, 37, 38, 39, 40 are movable by means of actuators (not shown) from an ON position (FIG. 4A) in which the respective cam cooperates with the stationary cam means 20 to an OFF position (FIG. 4B) in which the respective cam is located away from the stationary cam means 20. In the same manner, the additional movable cams 41, 42, 43, 44 are movable by means of actuators (not shown) from an ON position (FIG. 4A) in which the respective cam cooperates with the additionally stationary cam means 45 to an OFF position (FIG. 4B) in which the respective cam is located away from the cam means 45.

The movable cams 33, 36, 37, 40 are located above parts 24, 25, 25, 26 of the stationary cam means 20. The movable cams 33, 36, 37, 40 have a triangular shape with inclined parts, wherein an inclined part of a movable cam in its ON position is in line with the corresponding inclined part 27, 28, 29, 30, 31, 32 of the stationary cam means 20 to form a smooth transition from the second level II to the top of the triangular shaped movable cams 33, 35, 37, 39 at a third level III.

Each movable cam 34, 38 comprises a first horizontal part 46 at level II and a second inclined part 47 extending to level III. The movable cams 34, 35 respectively 38, 39 are located adjacent to each other and are an mirror image of each other. The movable cams 34, 35 respectively 38, 39 are located above parts 22 respectively 23 of the stationary cam means 20.

The additional movable cams 41, 42, 43, 44 are movable by means of actuators (not shown) operated by air pressure from an ON position (FIG. 4A) in which the respective cam cooperates with the additional cam means 45 to an OFF position (FIG. 4B) in which the respective cam is located away from the cam means 45. The located near additional stationary cam means 45. Each additional movable cams 41, 42, 43, 44 has an inclined part for moving the second cam follower 12 of a needle element 4 from a position belonging to the third level III to a position belonging to the first level I. During operation of the circular knitting machine 1, the movable cams 34, 38 and the additional movable cams 42, 44 will used when moving the needle cylinder 2 in a forward direction P1, whilst the movable cams 35, 39 and the additional movable cams 41, 43 will used when moving the needle cylinder 2 in a backward direction P2.

The additional stationary cam means 45 comprises V-shaped recesses 48 located opposite the triangular cams 33, 36, 37, 40.

The circular knitting machine 1 according to the invention also comprises feeds for yarns at the positions F1 and F2 located between the cams 41, 42 and the cams 43, 44 respectively.

Near each movable cam 33, 34, 35, 36, 37, 38, 39, 40 an actuation means 15 is located so that at just before each movable cam 33, 34, 35, 36, 37, 38, 39, 40 pin 13 of a needle element 4 can be put ON or OFF to activate or deactivate the needle element 4.

The operation of the circular knitting machine 1 according to the invention will be explained by means of the FIGS. 5-11, wherein depending on the kind of knitting specific movable cams and additional movable cams are being used.

Figure 5:
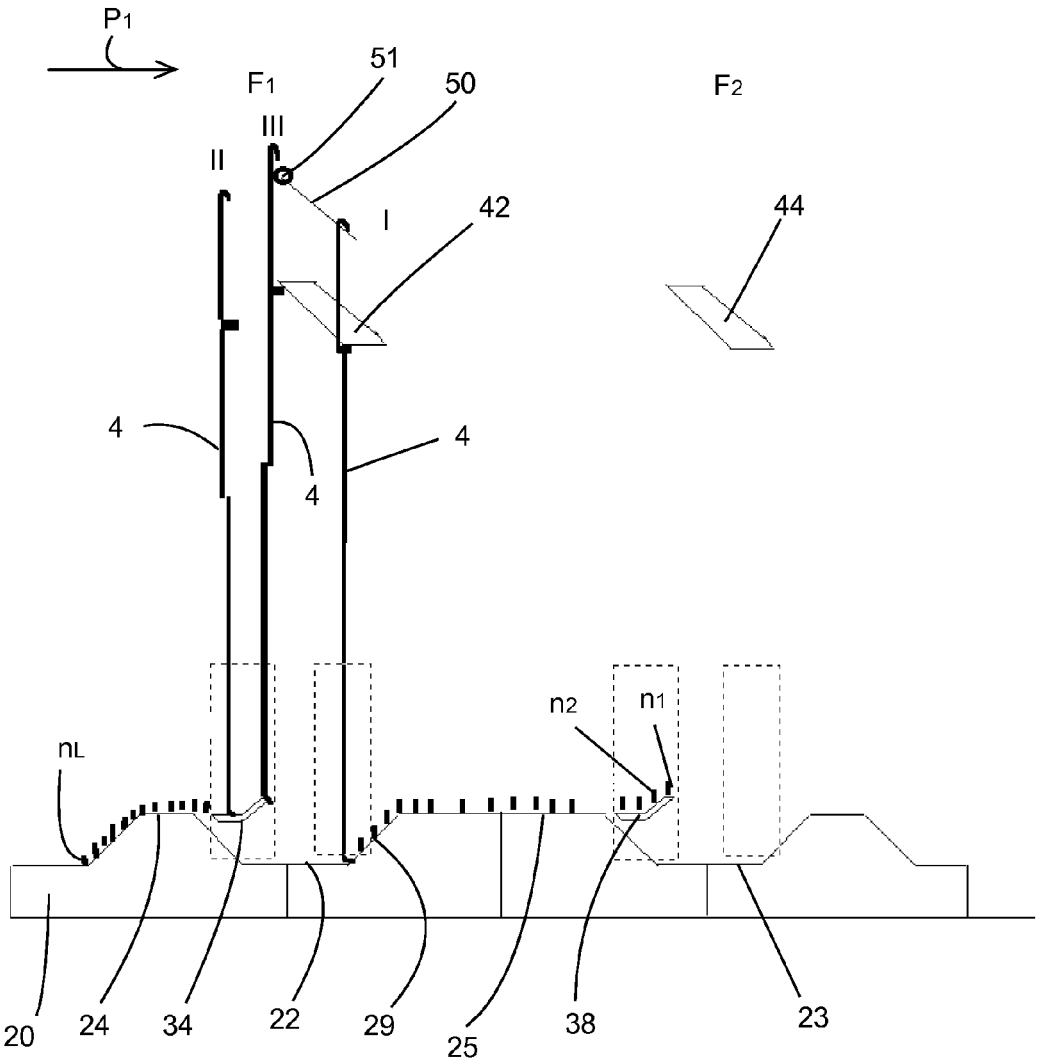
FIG. 5 is a schematic view of the cam means with some movable cams in their use position during normal stitching while the needle cylinder is moving forwards.

FIG. 5 shows an operation of the circular knitting machine 1 according to the invention, wherein the cams 34, 42 and 38, 44 are being used. A part of the needle elements 4, for example the needle elements located over 240 degrees of the needle cylinder 2 are being used.

During the movement of the needle cylinder 4 in the forward direction P1, the first cam follower 8 of a needle element 4 being in its active position will be guided over the part 24 and the cam 34, wherein the needle element 4 is being moved from a position at level II to a position at level III. Near position III a first yarn 50 will be inserted against the needle 5 above the open latch 11 and below the hook 10 by means of a yarn finger 51. This yarn finger 51 is located at position F1. When moving further in the forward direction P1, the second cam follower 12 of the needle element 4 will be guided along cam 42, wherein the needle element 4 is being moved from a position at level III to a position at level I to finish the stitch. At this level I, the first cam follower 8 is located against part 22 of the cam means 20. The cam follower 8 of the needle element 4 will follow the parts 29, 25 of the cam means 20 and will than be guided over the cam 38, wherein the needle element 4 is being moved from a position at level I and II to a position at level III. Near position III a second yarn 50 will be inserted against the needle 5 above the open latch 11 and below the hook 10 by means of a yarn finger 51. The needle element 4 will be moved back to level I by means of cam 44. In this manner two rows of stitches will be formed during the forward movement of the needle cylinder 2. The needle cylinder 2 will be moved over more than 360 degrees, for example over 540 degrees to ensure that the first needle elements n1, n2 and the last needle element nL will pass both the feed position F1 and F2. In the forward direction P1, the needle elements must first pass the feed position F1 and than the feed position F2. It is possible that the last needle elements 4 are located near feed position F2 when the first needle elements 4 are located near the feed position F1. To ensure that in such a situation no stitching takes place at the last needle elements 4, the cams 38, 44 are in their OFF position, until the last needle elements 4 have passed the position F2. When the first needle elements n1, n2 have reached the feed position F2, other needle elements 4 will be at feed position F1 so that at the same time stitches are being made at both positions.

Figure 6:
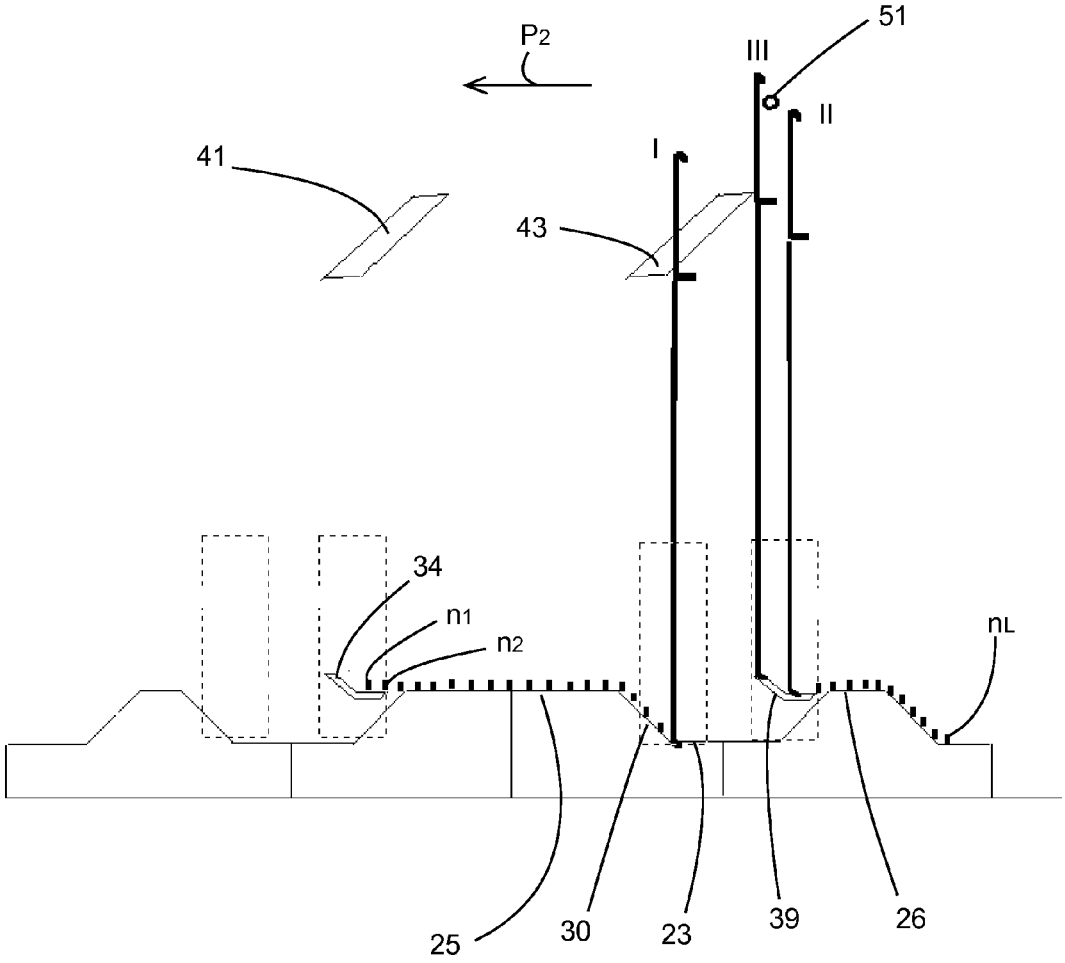
FIG. 6 is a schematic view of the cam means with some movable cams in their use position during normal stitching while the needle cylinder is moving backwards.

FIG. 6 shows an operation of the circular knitting machine 1 according to the invention, wherein the needle cylinder 2 is being rotated in backward direction P2 and the cams 39, 34 and 43, 41 are being used. During the movement of the needle cylinder 4 in the backward direction P2, the first cam follower 8 of a needle element 4 being in its active position will be guided over the part 26 and the cam 39, wherein the needle element 4 is being moved from a position at level II to a position at level III. Near position III the second yarn 50 will be inserted against the needle 5 above the open latch 11 and below the hook 10 by means of a yarn finger 51. This yarn finger 51 is located at position F2. When moving further in the backward direction P2, the second cam follower 12 of the needle element 4 will be guided along cam 43, wherein the needle element 4 is being moved from a position at level III to a position at level I to finish the stitch. At this level I, the first cam follower 8 is located against part 23 of the cam means 20. The cam follower 8 of the needle element 4 will follow the parts 30, 25 of the cam means 20 and will than be guided over the cam 34, wherein the needle element 4 is being moved from a position at level I and II to a position at level III. Near position III the first yarn 50 will be inserted against the needle 5 above the open latch 11 and below the hook 10 by means of a yarn finger 51. The needle element 4 will be moved back to level I by means of cam 41. In this manner two rows of stitches will be formed during the backward movement of the needle cylinder 2. The needle cylinder 2 will be moved over more than 360 degrees, for example over 540 degrees to ensure that the first needle elements n1, n2 (being the last needle elements during the movement in the forward direction) and the last needle element nL (being the first needle elements during the movement in the forward direction) will pass both the feed position F1 and F2. In the backward direction P1, the needle elements must first pass the feed position F2 and than the feed position F1. It is possible that the last needle elements 4 are located near feed position F1 when the first needle elements 4 are located near the feed position F2. To ensure that in such a situation no stitching takes place at the last needle elements 4, the cams 34, 41 are in their OFF position, until the last needle elements 4 have passed the position F1. When the first needle elements n1, n2 have reached the feed position F1, other needle elements 4 will be at feed position F2 so that at the same time stitches are being made at both positions.

During the forward and backward movement as shown in FIGS. 5 and 6 the other cams are in their OFF position.

Figure 7:
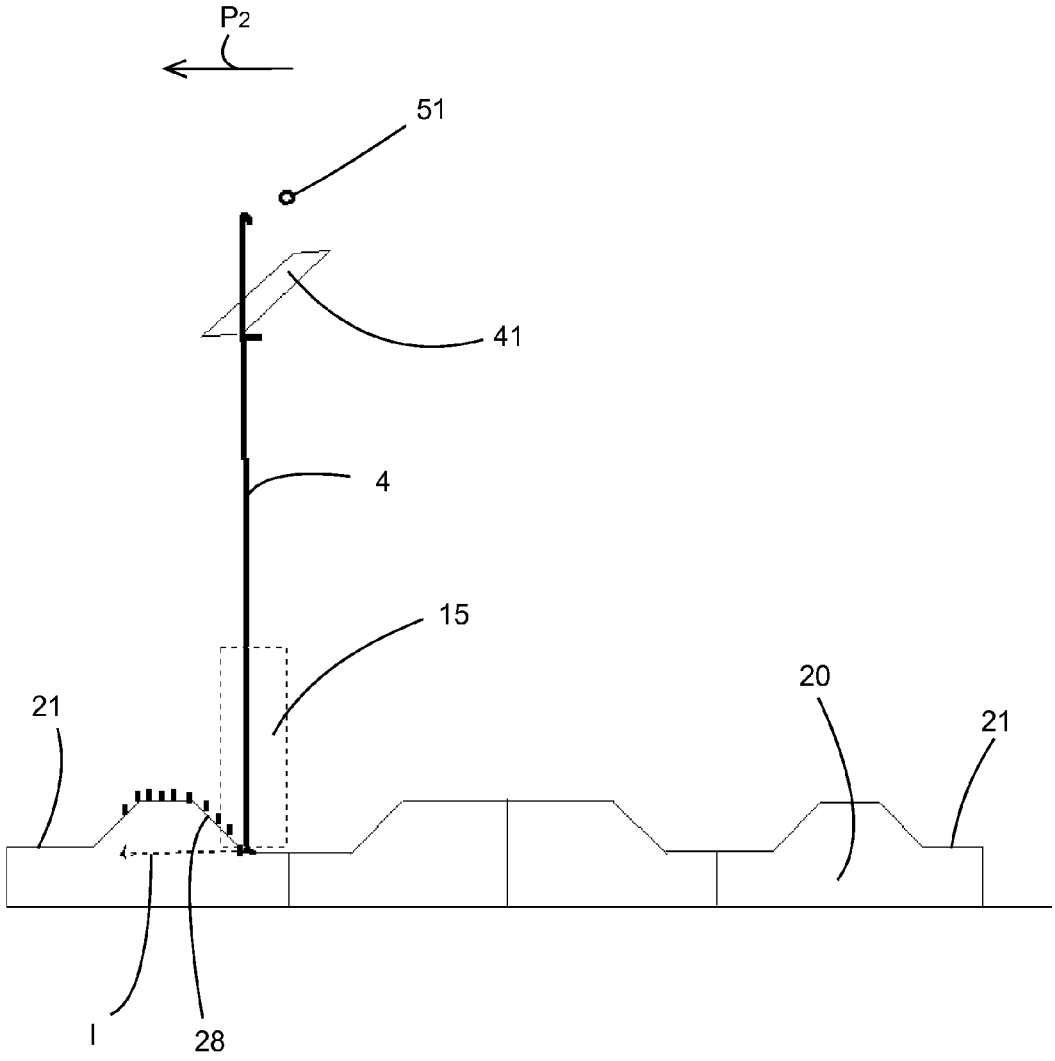
FIG. 7 is a schematic view of the cam means with an inactive needle element while the needle cylinder is moving backwards.

FIG. 7 shows the deactivation of a needle element 4 by means of an activation means 15 near the cam 34 and the inclined part 28 of the cam means 20. By placing the guiding element 16 in its ON position, the pin 13 of the needle element 4 will be put in its OFF position when passing the guiding element 16 and the first cam follower 8 will be moved away from the stationary cam means 20 in a direction towards the central axis 3. The cam follower 8 will not be able to follow the inclined part 28 but will maintain its axial position at level I.

Figure 8:
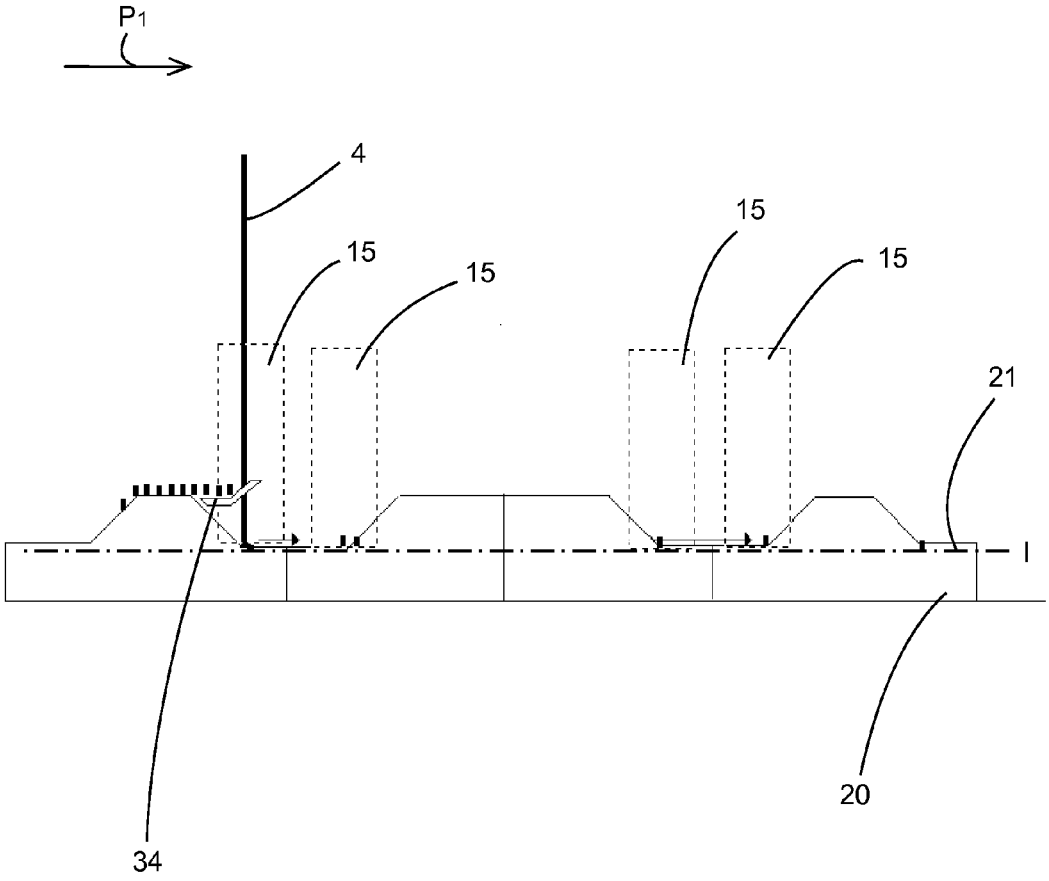
FIG. 8 is a schematic view of the cam means with inactive needle elements while the needle cylinder is moving forwards.

FIG. 8 shows that the needle element 4, which has been placed in its inactive position can be maintained in this inactive position, when moving again in the forward direction P1 by subsequently placing the guiding element 16 of the actuation means 15 located near the cams 34, 35, 38, 39 in its ON position so that the pin 13 of the needle element 4 will be put and maintained in its OFF position when passing the guiding element 16 and the first cam follower 8 will be forced to move behind the stationary cam means 20 and maintain its axial position at level I. Between the pair of actuators 34, 35; 38, 39 respectively the cam follower 8 will follow the horizontal path 22, 23. Between actuator 39 and actuator 34 the cam follower 8 will be maintained inactive behind the horizontal part 21. In the same manner a needle element 4 can be maintained constantly in its inactive position when moving in the backward direction P2.

Figure 9:
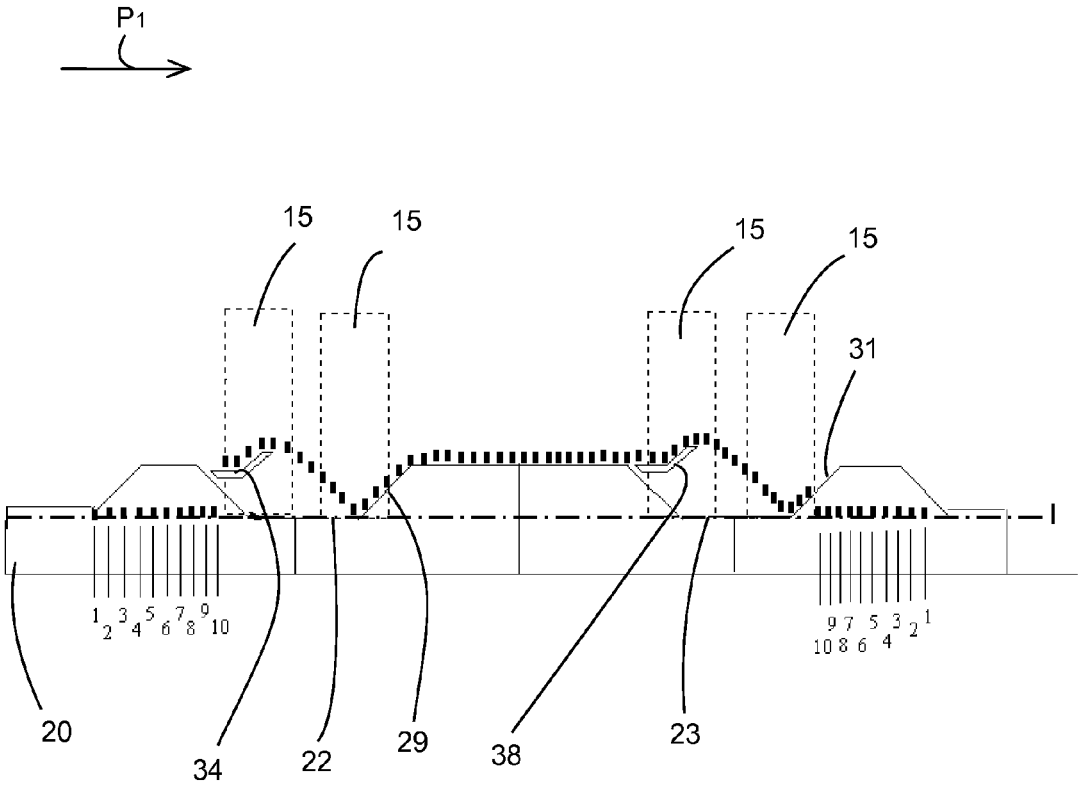
FIG. 9 is another schematic view of the cam means with inactive needle elements while the needle cylinder is moving forwards.

FIG. 9 shows a way for decreasing or increasing the number of active needle elements 4. During the last movement in backward direction P2, the outer needle elements 4 (numbers 1) have been placed in the inactive position. During the next movement in forward direction, the needle elements 4 with numbers 2 are located on the outside and are allowed to pass the cam 34 but are than made inactive by means of the actuation means 15 located near cam 35 and inclined part 29 so that no stitch will be made on these needles 4 (numbers 2) at feed position F2 near cam 38. Near feed position F2 the than outer needle elements 4 with numbers 3 are allowed to follow cam 38 to make a stitch but are than made inactive by mean of the actuation means 15 located near cam 39 and inclined part 31. As indicated above, the inactivated needle elements will maintain their inactive position as long as needed. As soon as it is desired to increase the number of active needle elements 4, the corresponding guiding elements 16 of the actuation means 15 will be put in their OFF position. As soon as the needle element 4 is no longer kept in its inactive position, the cam follower 8 will be moved on the stationary cam means 20 as soon as the cam follower 8 is located near the horizontal part 22 or 23, where the cam follower 8 will be moved away from the central axis 3 onto the cam means 20.

FIGS. 5-9 show the operation of the circular knitting machine 1 with a reciprocating movement while using two yarns at two different feed positions F1 and F2.

Figure 10:
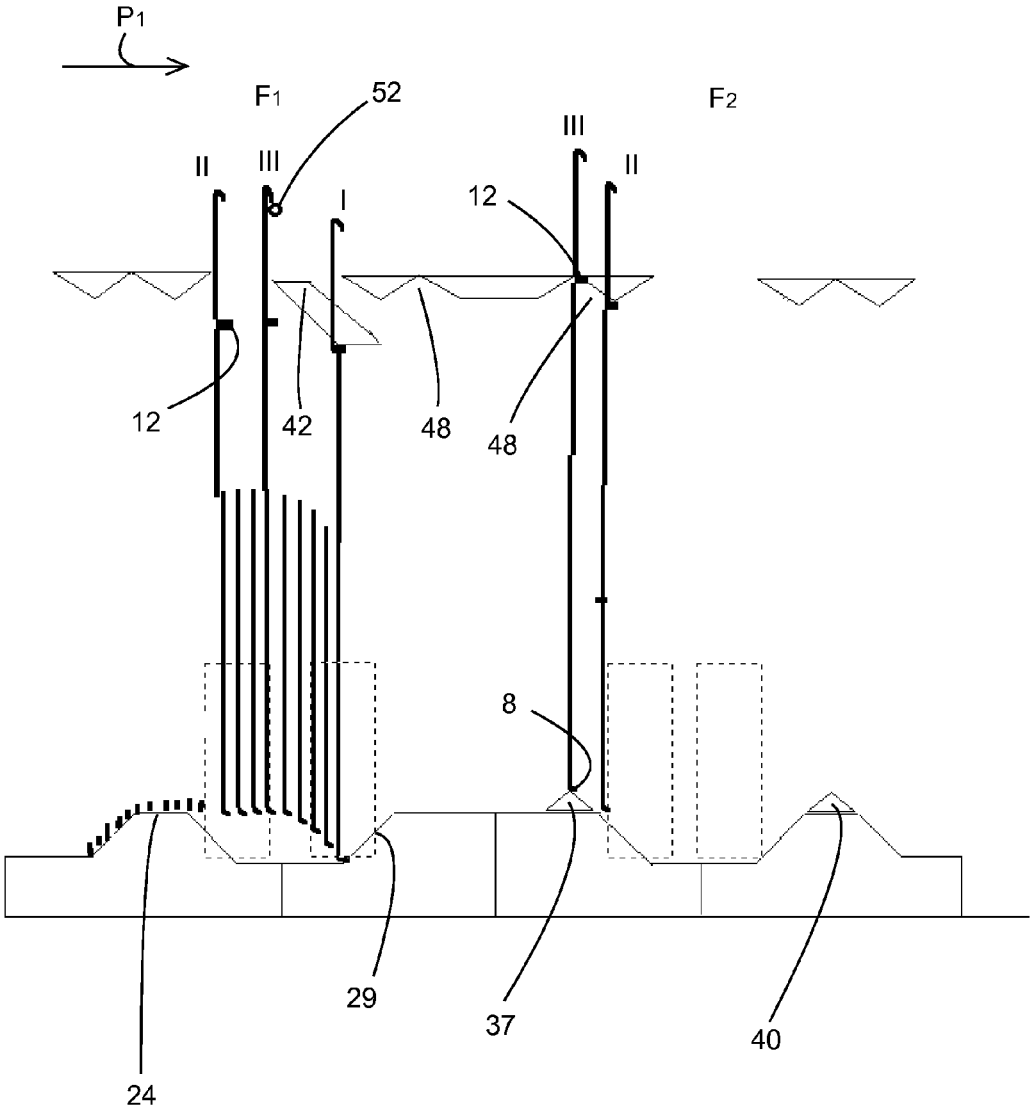
FIG. 10 is a schematic view of the cam means with triangular movable cams in their use position, while the needle cylinder is moving forwards.

FIG. 10 shows the operation of the circular knitting machine 1 with a reciprocating movement while using the triangular cam 37 instead of the cam 34 with the first and second part 46, 47. When moving in forward direction, the active needle elements 4 will follow the horizontal art 24 at level II. Since the cam 34 is in its OFF position, the needle elements 4 will remain on level II. At feed position F1, a yarn is being placed against the needle 5 above the open latch 11 and below the hook 10 by means of a yarn finger 52, when the needle 5 is at the second level II. Now there are two yarns placed against the needle 5 above the open latch 11 and below the hook 10, since the yarn applied at the last feed position is also still located against the open latch 11. By further movement of the needle element 4 in forward direction P1, the cam 42 will force the needle element 4 to move to level I, wherein the latch 11 is being closed. The needle element 4 will follow the inclined part 29 to level II and will than be moved over the triangular cam 37 which is placed in its ON position. During the movement to the third level III, both yarns will be moved to a position on the needle 5 below the open latch 11. In this manner a stitch will be formed comprising two yarns, wherein the last applied yarn (being applied by yarn finger 52) will be visible and the other yarn will be located below this yarn and will be less visible or complete hidden from view by the last applied yarn.

Figure 11:
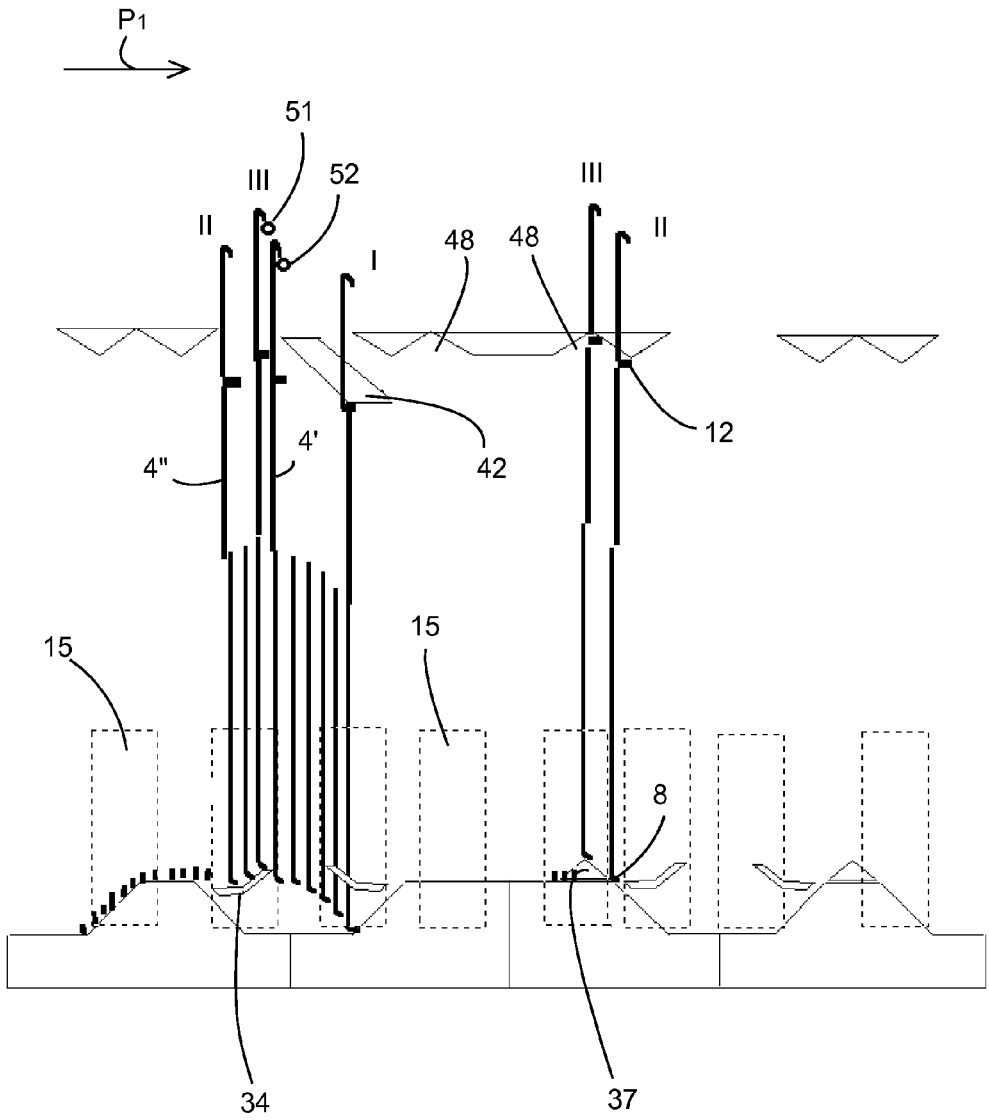
FIG. 11 is another schematic view of the cam means with triangular movable cams in their use position, while the needle cylinder is moving forwards, and yarns are being fed at the third position and the second position.

FIG. 11 shows the operation of the circular knitting machine 1 with a reciprocating movement while using either the cam 34 or triangular cam 37 to move the needle element 4 to the third level III. Both cams 34 and 37 are in their ON position. When moving in forward direction, the active needle elements 4' is will follow the horizontal part 24 at level II. By actuation means 15 near the cam 34, the guiding element 16 for the needle element 4' is put in its ON position so that the needle element 4' is put in its inactive position in which its first cam follower 8 will not follow the cam 34 but will maintain at the second level II. As explained at FIG. 10, at feed position F1, a yarn is placed against the needle 5 needle element 4' above the open latch 11 and below the hook 10 by means of a yarn finger 52, when the needle 5 needle element 4' is at the second level II. Now there are two yarns placed against the needle 5 needle element 4' above the open latch 11 and below the hook 10, since the yarn applied at the last feed position is also still located against the open latch 11. By further movement of the needle element 4' in forward direction P1, the cam 42 will force the needle element 4 to move to level I, wherein the latch 11 is being closed. The needle element 4' will follow the inclined part 29 to level II and will than be moved over the triangular cam 37 which is placed in its ON position. During the movement to the third level III, both yarns will be moved to a position on the needle 5 below the open latch 11. In this manner a stitch will be formed comprising two yarns, wherein the last applied yarn (being applied by yarn finger 52) will be visible and the other yarn will be located below this yarn and will be less visible or complete hidden from view by the last applied yarn.

As can be seen in FIG. 11, the needle element 4" located adjacent to needle element 4' is being moved by cam 34 to level III and will receive a yarn from yarn finger 51. The needle element 4" will be moved by means of cam 42 to level I.

The triangular cam 40 will be used for moving a needle element 4 to level III if a yarn is applied at feed position F2 at level II when moving the needle cylinder 2 in the forward direction. In the same way, the triangular cam 33 will be used for moving a needle element 4 to level III if a yarn is applied at feed position F1 at level II when moving the needle cylinder 2 in the backward direction. The triangular cam 37 will be used for moving a needle element 4 to level III if a yarn is applied at feed position F2 at level II when moving the needle cylinder 2 in the backward direction.

By having two feed positions F1 and F2 and having and each feed position two yarns fingers 51, 52 to apply a first yarn at level III and a second yarn at level II respectively, four different kinds of yarns can be used during each reciprocating movement in forward direction or backward direction. By the circular knitting machine according to the invention a knitted product can be made with reciprocating motion, wherein at each turn two rows of stitches are created, whilst in each row some stitches can be made of two yarns. By programming the actuation means of the needle elements, the ON and OFF positions of the cams and the yarn fingers 51, 52 it is possible to make a knitted product with any desired pattern in a relatively short period of time.

The movable cams 34, 37, 38, 40 and the actuators 15 located just in front of these cams can be used when the needle elements are being moved in forward direction. The other cams 33, 35, 36, 39 will not be used when moving in forward direction.

When moving in backward direction the movable cams 33, 35, 36, 39 and the actuators 15 located just in front of these cams can be used. The other cams 34, 37, 38, 40 will not be used when moving in backward direction.

Figure 12:
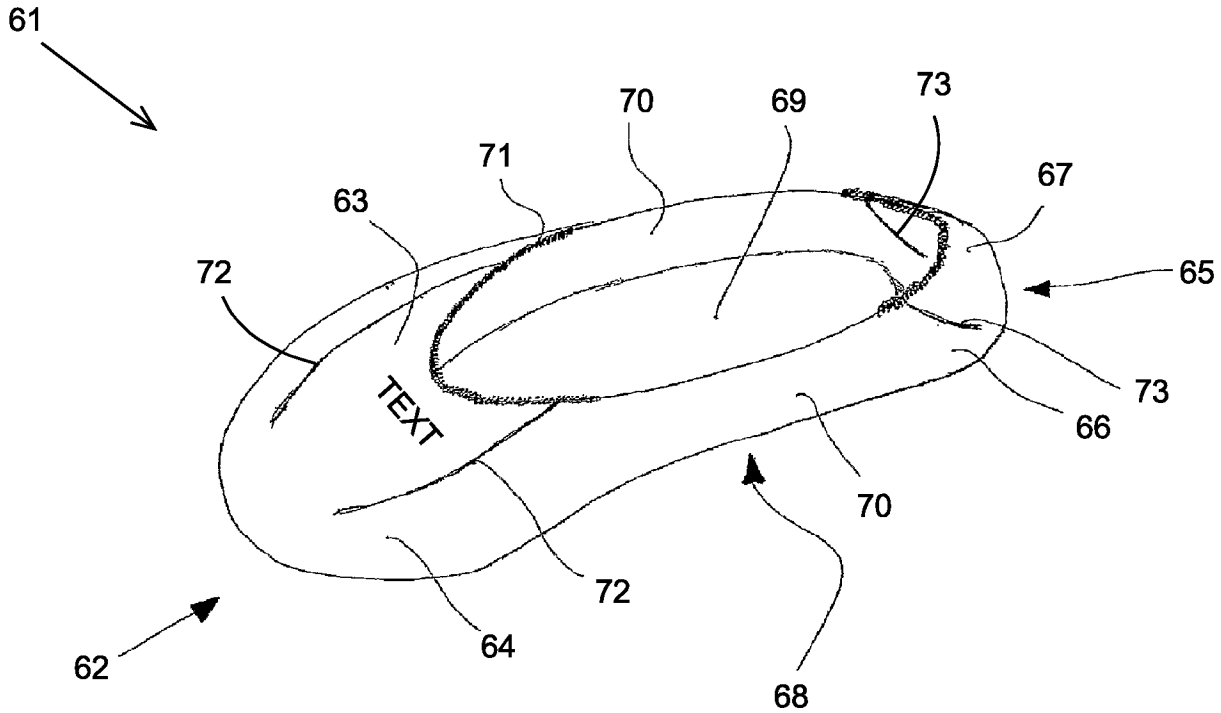
FIG. 12 is a schematic view of an ankle sock knitting with the circular knitting machine according to the invention.

FIG. 12 shows an ankle sock 61 made with the circular knitting machine 1 according to the invention. The ankle sock 61 is made by reciprocating motion in continuum stitching stitches without seams to form a single piece made up of:

a front end 62 elongated in the shape of a pocket, which can be associated with the toe of the foot and comprising a first front portion 63 and a second front portion 64, a rear end 65, also pocket shaped, able to be associated with the heel of the foot and comprising a first rear portion 66 and a second rear portion 67, and a connecting part 68 between the front end and rear end, comprising a sole portion 69, two side portions 70 and an opening between the side portions in which to insert the foot.

The ankle sock 61 is being made with the following steps:

stitching a first border 71, stitching the first front portion 62 continuously to the first border 71 and decreasing the number of active needle elements on both sides, stitching the second front portion 63 joining it continuously to the first front portion 62 along front weaving lines 72 by increasing the number of active needle elements on both sides, stitching the connecting part 68 joining it continuously to the second front portion 62;

stitching the first rear portion 66 joining it continuously to the connecting part 300, whilst decreasing the number of active needle elements on both sides, stitching the second rear portion 67 joining it continuously to the first rear portion 66 along rear weaving lines 73 by increasing the number of active needle elements on both sides, stitching a second border 74 continuously to the second rear portion 67 and if desirable to the side portions 70.

Whilst stitching each part by means in each row of stitches, a number of stitches can be made of two yarns, wherein one yarn is supplied at the third level III of the needle element 4 and one yarn is supplied at the second level II of the needle element 4. The fact that a yarn is supplied at the second level II can, for example, be deduced from the fact that the yarn is only available at some stitches in a row and is located on top of the yarn which is being used for making the row of stitches. The yarn supplied at the second level II can be used for making a text 75 in the first front portion 63.

It is possible to have more than two feed positions, wherein at each feed position yarns can be supplied at two different levels II and III.

In this manner it is possible to realize a jacquard-knitting with four different colours, a mesh stitch on various positions to obtain different forms, a relatively large part with two feeds at the same time, a logo or other kind of picture etc. Since the machine is computer controlled all kinds of patterns are possible wherein the machine can be changed very quickly from one pattern to another.

When reducing or increasing the number of active needle elements on both sides it is also possible to reduce the number on one side faster than on the other side. It is also possible to decrease with two needles on each side in the forward direction, to increase with one needle in backward direction and to decrease again with two needles on the forward direction until the desired number of needles is obtained.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A circular knitting machine comprising at least a rotatable needle cylinder provided with a number of axially extending slots, which needle cylinder is at least reciprocatingly rotatable in a forward direction and a backward direction, a number of needle elements slidably located in the slots, each needle element being provided with at least one cam follower and near an upper end thereof with a hook and a latch, the latch being pivotable with respect to the hook from an open position to a closed position, and vice versa, stationary cam means for moving the needle element in axial direction according to a predetermined path, which circular knitting machine is further provided with actuation means for moving at least the cam follower of each needle element from an active position in which the cam follower is engageable with the cam means for moving the needle element in axial direction to an inactive position in which the cam follower is disengaged of the cam means, and vice versa, wherein the knitting machine comprises at least one first and one second movable cam, each movable cam being movable between a rest position and a use position for amending the predetermined path of the stationary cam means and vice versa, wherein when the needle cylinder is being rotated in the forward direction the first movable cam is movable into its use position, whilst when the needle cylinder is being rotated in the backward direction, the second movable cam is movable into its use position, wherein the actuation means are provided near each movable cam for individually moving at least the cam follower of each needle element from an active position in which the cam follower is engageable with the corresponding movable cam to an inactive position in which the cam follower is disengaged of the corresponding movable cam, and vice versa.

2. A circular knitting machine according to claim 1, wherein the knitting machine comprises at least two pairs of movable cams, each pair comprises one first and one second movable cam, wherein the pairs are spaced apart in the rotational direction.

3. A circular knitting machine according to claim 1, wherein the stationary cam means define at least a first level and a second level of the needle element in axial direction, wherein each movable cam defines at least a third level of the needle element in axial direction, wherein the second level is located between the first level and the third level.

4. A circular knitting machine according to claim 3, wherein the circular knitting machine comprises additional movable cams located closer to the upper ends of the needle elements than the movable cams, each additional movable cam being movable between a rest position and a use position and defines a path for moving the needle element from the third level to the first level.

5. A circular knitting machine according to claim 4, wherein at least one movable cam defines in its use position a first path for maintaining the needle element at the second level and a second inclined path connected to the first path for moving the needle element from the second level to the third level, whilst said at least one movable cam cooperates with one of the additional movable cams in its use position, wherein a needle element being moved by one of the movable cams from the second level to the third level is being moved by the corresponding additional movable from the third level to the first level.

6. A circular knitting machine according to claim 4, wherein at least one movable cam is triangular shaped and defines on each side an inclined path from the second level to the third level, wherein near at least one side of said at least one movable cam the inclined path is aligned with an inclined path on the stationary cam means, which movable cam cooperates with the additional movable cam in its use position, for moving a needle element, by the stationary cam means from the first level to the second level, by the triangular shaped movable cam from the second level to the third level, by additional stationary cam means back to the second level and by the additional movable cam from the second level to the first level.

7. A method for knitting an article with a circular knitting machine wherein:

said circular knitting machine comprises at least a rotatable needle cylinder provided with a number of axially extending slots, a number of needle elements slidably located in the slots, each needle element being provided with at least one cam follower and near an upper end thereof with a hook and a latch, the latch being pivotable with respect to the hook from an open position to a closed position, and vice versa, a stationary cam means arranged to move the needle element in axial direction according to a predetermined path, which circular knitting machine is further provided with an actuator arranged to move at least the cam follower of each needle element from an active position in which the cam follower is engageable with the cam means to move the needle element in an axial direction to an inactive position in which the cam follower is disengaged of the cam means, and vice versa, wherein the knitting machine comprises at least one first and one second movable cam, each movable cam being movable between a rest position and a use position to amend the predetermined path of the cam means and vice versa, wherein, when the needle cylinder is being rotated in a forward direction, the first movable cam is movable into its use position, whilst when the needle cylinder is being rotated in a backward direction, the second movable cam is movable into its use position, wherein the actuators are provided near each movable cam for individually moving at least the cam follower of each needle element from an active position in which the cam follower is engageable with the corresponding movable cam to an inactive position in which the cam follower is disengaged of the corresponding movable cam, and vice versa; and the method comprising at least partially knitting the article by a reciprocating rotational movement of the needle cylinder in the forward direction and the backward direction, wherein the needle elements are either being moved in the axial direction of the needle cylinder by the stationary cam means according to the predetermined path or being moved in the axial direction of the needle cylinder by the movable cam according to an amended path or being disengaged from the cam means and movable cam, wherein the movement of each needle element near each movable cam can be individually controlled.

8. A method according to claim 7, wherein the needle elements are movable between a first level, a third level and a second level located between the first and third level, wherein a least a yarn is being fed to a needle element being near the third level.

9. A method according to claim 8, wherein for reducing the number of needle elements on which knitting during one forward or backward movement of the needle cylinder is being performed, needles elements are brought and maintained at the first level.

10. A method according to claim 9, wherein at least a yarn is being fed to a needle element being in the second level, where after said needle element is being moved from the second level to at least the third position by a movable cam.

11. A method according to claim 1, wherein the needle elements are movable between a first level, a third level and a second level located between the first and third level, wherein at least a yarn is being fed to a needle element being near the third level, a least a yarn is being fed to a needle element being in the second level, where after said needle element is being moved from the second level to at least the third level by a movable cam, at least a first yarn is being fed to a needle element being at the third level, and at least a second yarn is being fed to an adjacent needle element being at the second level where after both needle elements are brought to the first level, where after the needle element holding the second yarn is being moved from the second level to at least the third level by a movable cam.

12. A method according to claim 11, wherein the first yarn is being used for making a base part of the article being made with a reciprocating movement of the needle cylinder, whilst the second yarn is being used to apply a local pattern like a text or a figure on the base part during the reciprocating movement of the needle cylinder.

13. A method of making an ankle sock using a circular knitting machine, wherein:

said circular knitting machine comprises at least a rotatable needle cylinder provided with a number of axially extending slots, a number of needle elements slidably located in the slots, each needle element being provided with at least one cam follower and near an upper end thereof with a hook and a pivotable latch, the latch being pivotable with respect to the hook from an open position to a closed position, and vice versa, a stationary cam arranged to move the needle element in axial direction according to a predetermined path, which circular knitting machine is further provided with an actuator arranged to move at least the cam follower of each needle element from an active position in which the cam follower is engageable with the stationary cam to move the needle element in axial direction to an inactive position in which the cam follower is disengaged of the cam, and vice versa, wherein the knitting machine comprises at least one first and one second movable cam, each movable cam being movable between a rest position and a use position to amend the predetermined path of the stationary cam and vice versa, wherein, when the needle cylinder is being rotated in a forward direction, the first movable cam is movable into its use position, whilst when the needle cylinder is being rotated in a backward direction, the second movable cam is movable into its use position, wherein the actuators are provided near each movable cam and arranged to individually move at least the cam follower of each needle element from an active position in which the cam follower is engageable with the corresponding movable cam to an inactive position in which the cam follower is disengaged of the corresponding movable cam, and vice versa, the circular knitting machine being configured to knit at least part of the ankle sock by a reciprocating rotational movement of the needle cylinder in the forward direction and the backward direction, wherein the needle elements are either being moved in the axial direction of the needle cylinder by the stationary cam according to the predetermined path or being moved in the axial direction of the needle cylinder by the movable cam according to an amended path or being disengaged from the cam and movable cam, wherein the movement of each needle element near each movable cam can be individually controlled;

said method comprising:

forming, by reciprocating motion in continuum stitching stitches without seams, a single piece made up of a front end elongated in the shape of a pocket, which can be associated with a toe of a foot and comprising a first and a second front portion, a rear end, also pocket shaped, able to be associated with a heel of the foot and comprising a first and a second rear portion, and of a connecting part between the front end and rear end, comprising a sole portion, two side portions and an opening between the side portions in which to insert the foot, wherein the first and second front portions, the connecting part and the first and second rear portions are each realized by stitching with reciprocating motion of the needle cylinder of the circular knitting machine with at least two yarns, wherein in a single row of stitches made of the first yarn only some stitches are also made of the second yarn.

14. A circular knitting machine according to claim 1, wherein the actuation means are operable to move at least the cam follower to be engageable with the cam means for moving the needle element in axial direction and disengaged of one of said movable cams while said one of said movable cams is in its use position.

* * * * *